US008602231B2

(12) United States Patent
Smith et al.

(10) Patent No.: US 8,602,231 B2
(45) Date of Patent: Dec. 10, 2013

(54) DRAFT SILL WITH SPECIAL REAR DRAFT LUG FOR A RAILCAR

(75) Inventors: Stephen W. Smith, Dallas, TX (US); Shaun Richmond, Frankfort, IL (US); Christopher Crisafulli, Mansfield, TX (US)

(73) Assignee: Trinity Industries, Inc., Dallas, TX (US)

( * ) Notice: Subject to any disclaimer, the term of this patent is extended or adjusted under 35 U.S.C. 154(b) by 245 days.

(21) Appl. No.: 13/211,353

(22) Filed: Aug. 17, 2011

(65) Prior Publication Data

US 2012/0043292 A1 Feb. 23, 2012

Related U.S. Application Data

(60) Provisional application No. 61/374,973, filed on Aug. 18, 2010.

(51) Int. Cl.
*B61G 7/10* (2006.01)

(52) U.S. Cl.
USPC ..... 213/50; 213/51

(58) Field of Classification Search
USPC ..... 213/50–61, 69
See application file for complete search history.

(56) References Cited

U.S. PATENT DOCUMENTS

| | | | | |
|---|---|---|---|---|
| 3,664,269 | A * | 5/1972 | Fillion | 105/199.4 |
| 3,670,662 | A * | 6/1972 | Fillion | 105/199.4 |
| 4,056,065 | A * | 11/1977 | Fiegl et al. | 105/199.4 |
| 4,180,001 | A * | 12/1979 | McNally | 105/420 |
| 4,252,068 | A * | 2/1981 | Nolan | 105/420 |
| 4,445,617 | A * | 5/1984 | Elliott | 213/60 |
| 6,024,233 | A * | 2/2000 | Natschke et al. | 213/50 |
| 6,073,787 | A * | 6/2000 | Daugherty et al. | 213/50 |
| 6,390,313 | B1 * | 5/2002 | Ring et al. | 213/62 R |
| 6,986,432 | B2 * | 1/2006 | Limbach et al. | 213/51 |
| 2010/0320167 | A1 * | 12/2010 | Forbes | 213/51 |
| 2012/0043292 | A1 * | 2/2012 | Smith et al. | 213/51 |

OTHER PUBLICATIONS

*The Low Profile Story*; Dresser Industries, Inc., 1970.
*Cast Draft Still*; Dresser Industries, Inc., Prior to 2000.

* cited by examiner

*Primary Examiner* — Jason C Smith
(74) *Attorney, Agent, or Firm* — Baker Botts L.L.P.

(57) ABSTRACT

A draft sill with special rear draft lug for a railcar is disclosed. In some embodiments, a rear draft lug comprises a metallic body. The rear draft lug further comprises a boss extending along a transverse portion of the metallic body. The boss is configured to be coupled to a first vertical reinforcement plate. The rear draft lug also comprises an overhang portion extending from the boss along the transverse portion. The overhang portion configured to be coupled to the first vertical reinforcement plate. In some embodiments, the boss and the overhang portion are configured to be coupled to the first vertical reinforcement plate with a weld.

16 Claims, 5 Drawing Sheets

DRAFT SILL WITH SPECIAL REAR DRAFT LUG FOR A RAILCAR

RELATED APPLICATION

This application claims benefit under 35 U.S.C. §119(e) of U.S. Provisional Application Ser. No. 61/374,973, entitled "DRAFT SILL WITH SPECIAL REAR DRAFT LUG FOR A RAILCAR," filed Aug. 18, 2010, which is herein incorporated by reference.

TECHNICAL FIELD OF THE INVENTION

The invention relates generally to a draft sill for railcars, and more specifically to a draft sill with special rear draft lug for a railcar.

BACKGROUND OF THE INVENTION

Rear draft lugs are an integral part of the railcar draft system designed to transmit compressive draft gear loads into the center sill. In cars with 4', 11¼" overhangs and standard 24⅝" draft pockets the typical standard rear lugs physically interfere with the center plate/center filler vertical reinforcement.

SUMMARY OF THE INVENTION

In accordance with particular embodiments of the present disclosure, the disadvantages and problems associated with rear draft lugs for a draft sill have been substantially reduced or eliminated.

In accordance with particular embodiments of the present disclosure a system includes a railcar draft sill configured to be positioned in a rail car. The system also includes a first vertical reinforcement plate. The system further includes a rear draft lug. The rear draft lug comprises a boss extending along a transverse portion of the rear draft lug. The boss is configured to be coupled to the first vertical reinforcement plate. The rear draft lug further comprises an overhang portion extending from the boss along the transverse portion. The overhang portion is configured to be coupled to the first vertical reinforcement plate. The first vertical reinforcement plate is configured to be coupled to the rear draft lug with a weld.

In accordance with another embodiment of the present disclosure, a rear draft lug for a railcar draft sill comprises a metallic body. The rear draft lug further comprises a boss extending along a transverse portion of the metallic body. The boss is configured to be coupled to a first vertical reinforcement plate. The rear draft lug further comprises an overhang portion extending from the boss along the transverse portion. The overhang portion is configured to be coupled to the first vertical reinforcement plate. The boss and the overhang portion are configured to be coupled to the first vertical reinforcement plate by being coupled to the first vertical reinforcement plate with a weld.

In accordance with yet another embodiment of the present disclosure, a method includes forming a metallic body. The method also includes forming a boss on the metallic body extending along a transverse portion of the metallic body, the boss configured to be coupled to a first vertical reinforcement plate. The method also includes forming an overhang portion extending from the boss along the transverse portion, the overhang portion configured to be coupled to the first vertical reinforcement plate. The boss and the overhang portion are configured to be coupled to the first vertical reinforcement plate by being coupled to the first vertical reinforcement plate with a weld.

Technical advantages provided by particular embodiments of the present disclosure may include increasing fatigue life associated with draft sills and rear draft lugs by enabling the rear draft lug to be welded to a draft sill without cutting slots in the draft sill web. Particular embodiments provide chamfered slots that allow for welding a rear draft lug to a sill web prior to assembly of the draft sill. Moreover, particular embodiments of the present disclosure include a rear draft lug with slots for welding to a center sill and a vertical landing for full height center plate reinforcement welds. A rear draft lug in accordance with particular embodiments fits tight to the top of center sill for welding, which increases fatigue life and overall quality of draft sill systems. Particular embodiments of the present disclosure enable draft lugs to receive approximately 1,250,000 pounds of force while being manufacture to a lighter weight than previous designs. Moreover, rear draft lugs that include one or more slots may comparatively reduce the weight of a rear draft lug. In some embodiments, the reduced weight may measure up to or exceed 350 pounds. As a result, embodiments of the disclosure may provide numerous technical advantages. Particular embodiments, however, may provide some, none, all, or additional technical advantages.

BRIEF DESCRIPTION OF THE DRAWINGS

For a more complete understanding of the present disclosure and its advantages, reference is made to the following descriptions, taken in conjunction with the accompanying drawings, in which.

DETAILED DESCRIPTION OF EXAMPLE EMBODIMENTS

A draft sill with special rear draft lug for a railcar is disclosed. The 4'-11½" overhang dimension draft sill has historically been a requirement in Coal Unit Train environments using complete cast draft sills. Covered hopper cars have utilized 5'-10" overhang fabricated draft sills since the introduction of the Pullman 4750 covered hopper car and which continued through the development of the Trinity 5161 covered hopper cars. In cars with 4', 11½" overhangs and standard 24⅝" draft pockets, the typical standard rear lugs physically interfere with the center plate/center filler vertical reinforcement. This has forced most cars with 4', 11½" overhangs to use one piece cast draft sills. However, integrating the rear draft lug and center plate reinforcement usually requires cutting slots in the draft sill and filler vertical reinforcement plates to have cutouts that are more difficult to weld, requiring weld starts and stops that are susceptible to fatigue. Accordingly, the disadvantages and problems associated with prior rear draft lug systems and methods have been substantially reduced or eliminated.

Figure 1A:
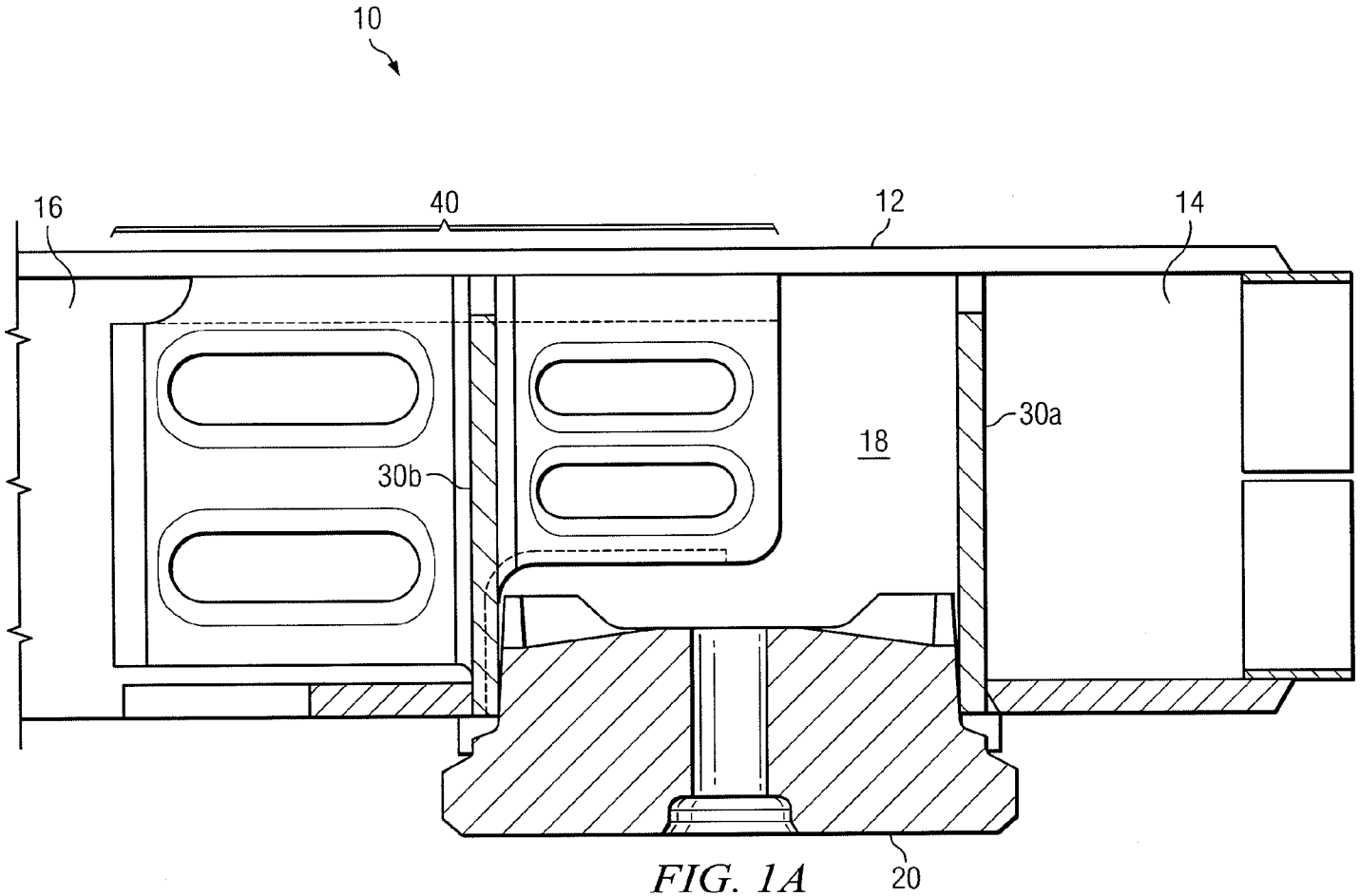
FIGS. 1A and 1B illustrate various views of a draft sill, including a center plate, vertical reinforcement plates, and a rear draft lug in accordance with a particular embodiment.
Figure 1B:
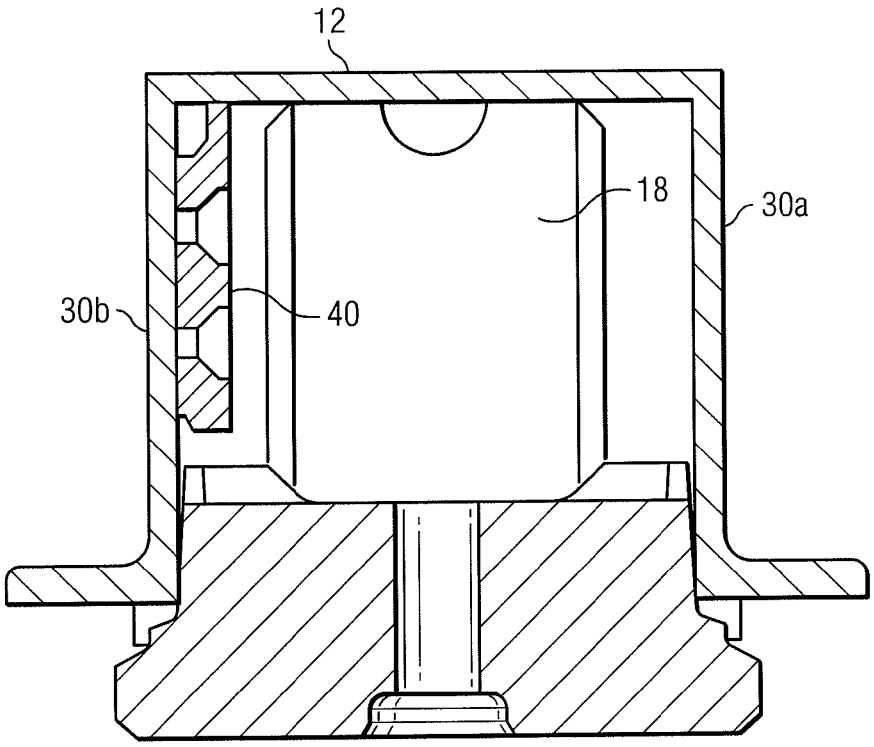

FIG. 1A illustrate various views of draft sill 10 that includes center plate 20, vertical reinforcement plates 30*a* and 30*b*, and rear draft lug 40. FIGS. 1A and 1B illustrate a cross-sectional view through a center line of draft sill 10. Draft sill 10 comprises a generally hollow, elongated rectangular body having a pair of elongated, parallel side walls 14 extending perpendicularly downward from the sides of an elongated top wall 12. Draft sill 10 may be cast steel and/or fabricated from plate and rolled steel sections. In an installed position, draft sill 10 may be coupled to an end sill, body bolster, and/or a center sill of a railcar. Additionally, top wall 12 of draft sill 10 may be welded to the bottom of a railcar. Draft pocket 16 is sized to receive a coupler yoke and associated draft gear. Center plate 20 includes a circular portion receivable in a complementary-shaped portion of a railcar truck. Center plate pocket 18 is generally cubic and formed by welding vertical reinforcement plates 30*a* and 30*b* to top wall 12 and/or side walls 14 of draft sill 10. In particular embodiments, vertical reinforcement plate 30*b* may be at least partially welded along a vertical portion of vertical reinforcement plate 30*b* to rear draft lug 40. Although FIGS. 1A and 1B illustrate for purposes of example a single rear draft lug 40, it should be understood that a second draft lug is typically welded to an opposing side wall 14 across from the rear draft lug 40 shown in FIGS. 1A and 1B.

One or more rear draft lugs 40 may facilitate the absorption and/or transfer of draft or compressive forces during coupling and/or motion of railcars. Rear draft lug 40 comprises a metallic body upon or in which other portions of rear draft lug 40 are formed. In some embodiments, rear draft lug 40 may be formed from a one piece cast steel, iron, metal alloy, or other metal or composite material. Rear draft lugs 40 may be configured to absorb a force being received in a direction parallel to chamfered slots 41. In some embodiments, chamfered slots 41 are not chamfered, and may instead include straight and/or right angled edges. Center plate pocket 18 may be appropriately sized to receive center plate 20. To secure center plate 20 in center plate pocket 18, center plate 20 may be welded to vertical plates 30, rear draft lugs 40, and/or draft sill 10. Dimensions of draft sill 10, center plate 20, vertical reinforcement plates 30, and rear draft lugs 40 may include those shown in FIG. 1A but may additionally or alternatively include any appropriate dimensions suitable to perform the described operations. Rear draft lugs 40 may also be of any appropriate shape and configuration suitable to perform the described operations. In some embodiments, rear draft lugs 40 may absorb more than 1,250,000 pounds of force when in operation.

Figure 2A:
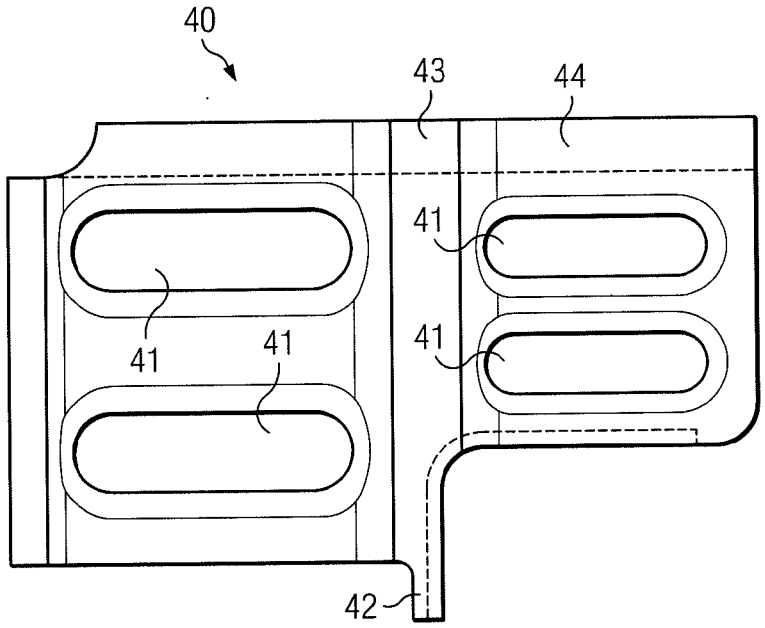
FIGS. 2A-2C illustrate various views of the rear draft lug shown in FIGS. 1A and 1B in greater detail.
Figure 2B:
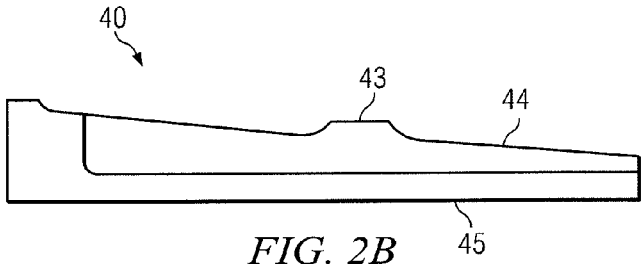
Figure 2C:
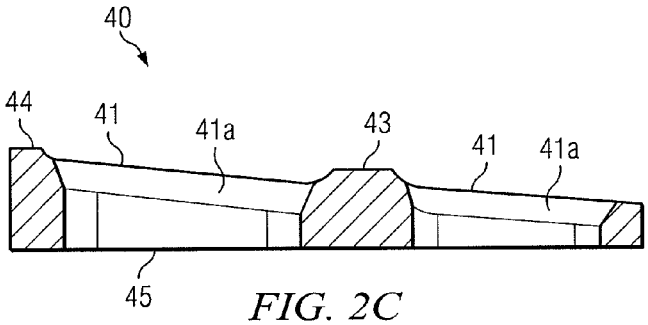

Particular embodiments of rear draft lug and/or draft sill 10 may be constructed in several ways. As one example, rear draft lug 40 may be formed from a metallic body comprising steel, iron, composite, or other material. In some embodiments, the metallic body is a one piece cast metal form. Additionally, a boss (such as, e.g., boss 43) may be formed on the metallic body. As shown in FIGS. 2A-2C, boss 43 may be formed and extend along a transverse portion of the metallic body. As discussed further herein, boss 43 may comprise a raised, flat portion of the metal body configured to be coupled to a vertical reinforcement plate (such as, e.g. vertical reinforcement plate 30*b*). Further, an overhang portion may be formed and extend from the boss along a transverse portion of the metal body. As shown in FIGS. 1A and 1B, and FIGS. 2A-2C the overhang portion may be configured to be coupled to a vertical reinforcement plate (such as, e.g. vertical reinforcement plate 30*b*). Some or all portions of rear draft lug 40 may be formed by casting a metal material into a single metal body.

As shown in the accompanying figures, in some embodiments, rear draft lug 40 may be formed such that it has a wider end and a narrow end. A wider end may be formed and configured to be positioned closest to an end of the rail car in an installed position. A narrow end may be formed and configured to be positioned closest to a center of the rail car in an installed position. Thus, the metallic body may generally taper from the wider end to the narrower end.

In some embodiments, rear draft lug 40 may be formed such that it includes one or more chamfered slots in the metallic body. Chamfered slots 40 reduce the overall weight of rear draft lug 40 and may be configured to receive a weld along a respective interior perimeter of the chamfered slot.

In an installed configuration, a portion of a center plate pocket in a rail car draft sill is formed from rear draft lug 40, vertical reinforcement plates 30*a* and 30*b* and draft sill 10. Thus, the center plate pocket comprises a cavity formed in part from the metallic body, vertical reinforcement plates 30*a* and 30*b*, and one or more side walls of a rail car draft sill. The metallic body may be coupled to one or more side walls of a rail car draft sill with one or more welds along an exterior perimeter of the metal body. In some embodiments, rear draft lug 40 may be coupled to one or more side walls of a draft sill (e.g., draft sill 10) with a continuous weld along at least a portion of rear draft lug 40. Moreover, the boss and the overhang portion may be coupled to a vertical reinforcement plate (e.g., vertical reinforcement plate 30*a* with a continuous weld along at least a portion of the boss and/or the overhang portion.

FIGS. 2A-2C illustrate various views of rear draft lug 40 discussed above with respect to FIGS. 1A and 1B. As shown in FIGS. 2A-2C, rear draft lug 40 may be generally tapered and/or wedge-shaped, with a wider, front portion facing the end of a railcar and a narrower, end portion facing towards a center of a railcar. Rear draft lug 40 may be formed from cast steel and/or fabricated steel components. Fabricated draft sill 10 with rear draft lug 40 are optimized for weight and may reduce the weight of the two draft sills in the car by 350 pounds per car compared to two traditional cast draft sills.

FIG. 2A is a top view of rear draft lug 40 showing a top surface 44 of rear draft lug 40, chamfered slots 41, overhang portion 42, and boss 43. In particular embodiments, chamfered slots 41 reduce the overall weight of rear draft lug 40 and provide an opening in rear draft lug 40 through which rear draft lug 40 may be coupled to a draft sill. For example, in some embodiments, bottom surface 45 opposing top surface 44 may be secured to side wall 14 of draft sill 10 by welding around an interior perimeter of chamfered slots 41 and around an exterior perimeter of rear draft lug 40. Rear draft lug 40 may be welded to draft sill 10 without cutting slots in the draft sill 10 web, which allows for welding to the draft sill 10 web prior to assembly of draft sill 10. Eliminating slots in the webs of draft sill 10 enhances quality and can increase fatigue life, since welds without stops and starts may be stronger over the life of the railcar.

Boss 43 provides an area for securing additional components to rear draft lug 40. For example, in some embodiments, boss 43 provides a raised, flat surface on rear draft lug 40 for securing vertical reinforcement plates 30 (such as, e.g., vertical reinforcement plate 30*b* shown in FIG. 1A) to rear draft lug 40. In some embodiments, boss 43 extends along a generally transverse axis of rear draft lug 40. For example, boss 43 may extend in along a direction generally perpendicular to a direction of the chamfered slots 41 illustrated in FIGS.

2A-2C. Thus, in some embodiments, boss 43 extends across a width of rear lug 40 to receive vertical plate 30*b*. In particular embodiments, vertical reinforcement plates 30 may be welded to rear draft lug 40 by welding a continuous line of weld along boss 43.

As shown in FIG. 2A, overhang 42 is an extension of boss 43 and provides additional area for securing additional components to rear draft lug 40. For example, in some embodiments, overhang 42 provides a flat surface on rear draft lug 40 for securing vertical reinforcement plates 30 (such as, e.g. vertical reinforcement plate 30*b* shown in FIG. 1A) to rear draft lug 40. In some embodiments, overhang 42 extends in a vertical dimension of rear draft lug 40 from top surface 44 to bottom surface 45. Thus, overhang 42 may be welded to side wall 14 of draft sill 10 and vertical reinforcement plate 30. As a consequence of overhang 42 extending or protruding outwardly from boss 43, vertical reinforcement plates 30 are able to be welded in a continuous line from top wall 12 of draft sill 10 to a bottom edge of draft sill 10. As a result, rear draft lug 40 allows for a full height weld of vertical reinforcement plates 30, without weld stops and starts.

FIG. 2B illustrates a side view of rear draft lug 40. As shown in FIG. 2B, rear draft lug 40 includes top surface 44, bottom surface 45, and boss 43. As shown in FIG. 2B, bottom surface 45 provides a flat surface on rear draft lug 40 that may abut and/or be coupled to a side wall of a draft sill (such as, e.g., side wall 14 of draft sill 10 shown in FIG. 1A). In some embodiments, rear draft lug 40 is coupled to a side wall of a draft sill via welds around a perimeter of rear draft lug 40 and an interior perimeter of chamfered slots 41. Rear draft lug 40 may be coupled to a side wall of a draft sill via one or more continuous welds, thus providing rear draft lug 40 with increased fatigue life when installed in a draft sill. As discussed above, boss 43 provides a raised (relative to other portions of rear draft lug 40), flat surface on rear draft lug 40 for securing vertical reinforcement plates 30 (such as, e.g., vertical reinforcement plate 30*b* shown in FIG. 1A) to rear draft lug 40. Moreover, vertical reinforcement plates 30 may be welded in a single continuous line along boss 43.

FIG. 2C illustrates a cross-sectional view of rear draft lug 40. FIG. 2C rear draft lug includes bottom surface 44, top surface 44, chamfered slots 41, chamfered surfaces 41*a*, and boss 43. As discussed above, chamfered slots 41 reduce the overall weight of rear draft lug 40 and provide an opening in rear draft lug 40 through which rear draft lug 40 may be coupled to a draft sill. Rear draft lug 40 may be secured to a side wall of a center sill of a railcar (such as, e.g., side wall 14 of center sill 10 shown in FIG. 1A). Additionally, FIG. 2C illustrates chamfered surfaces 41*a* of chamfered slots 41. In some embodiments, chamfered surfaces reduce the overall weight of rear draft lug 40. In some embodiments, chamfered slots 41 are not chamfered, and may instead include straight and/or right-angled edges. FIG. 2C also illustrates a cross-sectional view of boss 43 and overhang portion 42, which provide a raised, flat surface upon which vertical reinforcement plates 30 (such as, e.g., vertical reinforcement plate 30*b* shown in FIG. 1A) may be welded.

Previously, vertical reinforcement plates 30 and the like were welded to draft lugs using welds that includes stops and starts (i.e., not continuous welds). Welds used on previous systems would stop and start, which has the tendency to fatigue more easily and/or create stress raisers over time. However, in accordance with particular embodiments of the present disclosure, vertical reinforcement plates 30 may be welded to boss 43 and/or overhang portion 42 of rear draft lug 40 through a continuous weld without stops. This creates a continuous, full-height weld from a top surface of a draft sill to a bottom surface of a draft sill. As a result, fatigue life in a heavily loaded area of a railcar is improved.

Figure 3:
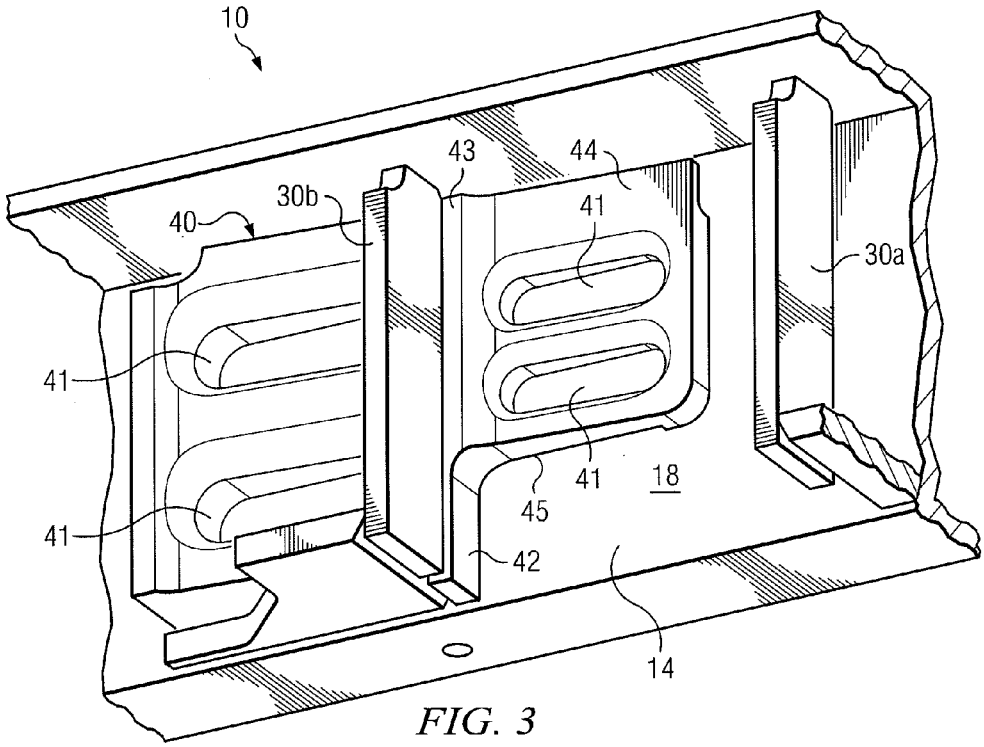
FIG. 3 illustrates a three-dimensional cutaway view of the rear draft lug coupled to a side wall of the draft sill shown in FIGS. 1A and 1B.

FIG. 3 illustrates a three-dimensional cutaway view of rear draft lug 40 coupled to side wall 14 of draft sill 10. As shown in FIG. 3, rear draft lug 40 includes chamfered slots 41, overhang 42, boss 43, top surface 44, and bottom surface 45. In an installed position, bottom surface 45 of rear draft lug 40 may abut and/or be welded to side wall 14 of rear draft lug 40. For example, one or more continuous welds may be placed around an external perimeter of rear draft lug 40 and an internal perimeter of one or more chamfered slots 40. Additionally, particular embodiments may include vertical reinforcement plate 30*a* welded to side wall 14 of draft sill 10. Vertical reinforcement plate 30*b* may be welded in a continuous line along boss 43 and overhang portion 42. FIG. 3 illustrates a center plate pocket 18 which, in some embodiments, includes the area formed between vertical center plates 30*a*, 30*b* and the side walls of center sill 10 (such as, e.g., side wall 14). As shown in FIG. 3, rear draft lug may be tapered along a particular direction. For example, rear draft lug 40 may be wider toward the end of a railcar (e.g., furthest from vertical reinforcement plate 30*a*), and narrower toward the center of a railcar (e.g., closest to vertical reinforcement plate 30*a*).

Figure 4:
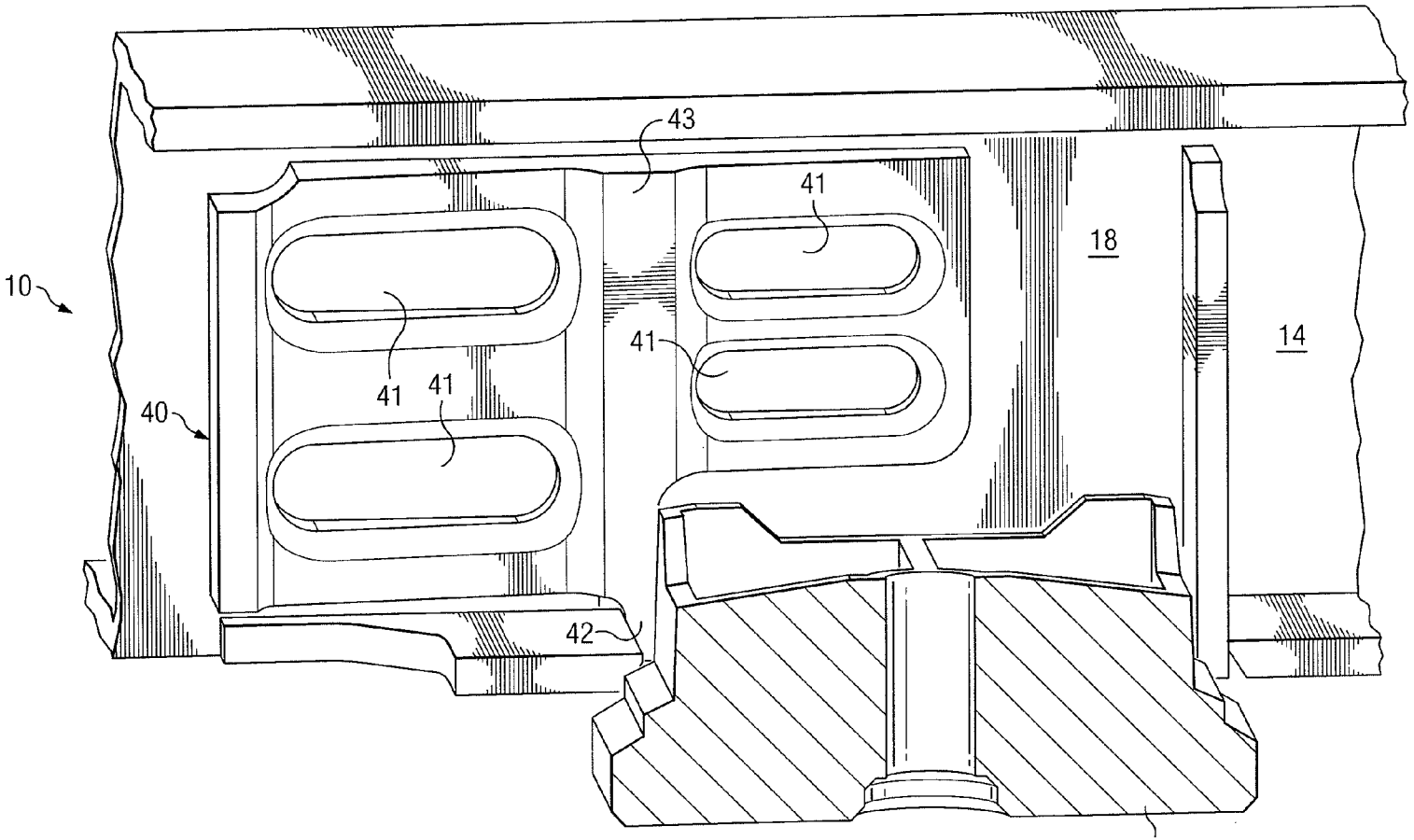
FIG. 4 illustrates a three-dimensional cutaway view of the rear draft lug shown in FIGS. 1A and 1B.

FIG. 4 illustrates a three-dimensional cutaway view of rear draft lug 40 coupled to side wall 14 of draft sill 10. As shown in FIG. 4, rear draft lug 40 includes chamfered slots 41, overhang 42, boss 43, top surface 44, and bottom surface 45. In an installed position, rear draft lug 40 may abut and/or be welded to side wall 14 of rear draft lug 40. As shown in FIG. 4, a center plate of a railcar (e.g., center plate 20) is positioned in center plate pocket 18. Center plate pocket may be formed by welding vertical reinforcement plate 30*a* to boss 43, top wall 12 and/or side walls 14 of draft sill 10, and welding vertical reinforcement plate 30*b* to side walls 14 and top wall 12 of draft sill 10. In some embodiments, center plate 20 may be coupled to draft sill 10 on a bottom portion of draft sill 10, where it may be received in a cooperatively-shaped portion of a railcar truck.

Figure 5:
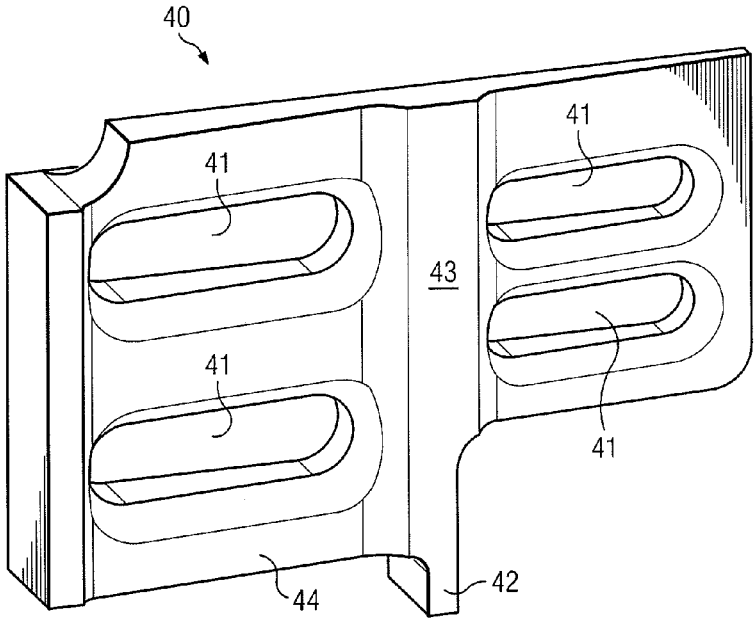
FIG. 5 illustrates a three-dimensional top view of the rear draft lug shown in FIGS. 1A and 1B.

FIG. 5 illustrates a three-dimensional top view of the rear draft lug 40. As shown in FIG. 5, rear draft lug 40 includes top surface 44, boss 43, overhang portion 42, and chamfered slots 41. In some embodiments, boss 43 and overhang 42 extend along a transverse axis of rear draft lug 40 (e.g., in a direction perpendicular to a length of chamfered slots 41) and provide an area for securing additional components to rear draft lug 40. For example, boss 43 and/or overhang 42 provide flat surface on rear draft lug 40 for securing vertical reinforcement plates 30 (such as, e.g., vertical reinforcement plate 30*b* shown in FIG. 1A) to rear draft lug 40. Chamfered slots 41 provide an opening in rear draft lug 40 through which rear draft lug 40 may be coupled to a draft sill. In some embodiments, chamfered slots 41 may be appropriately sized to reduce the overall weight of rear draft lug 40.

Figure 6:
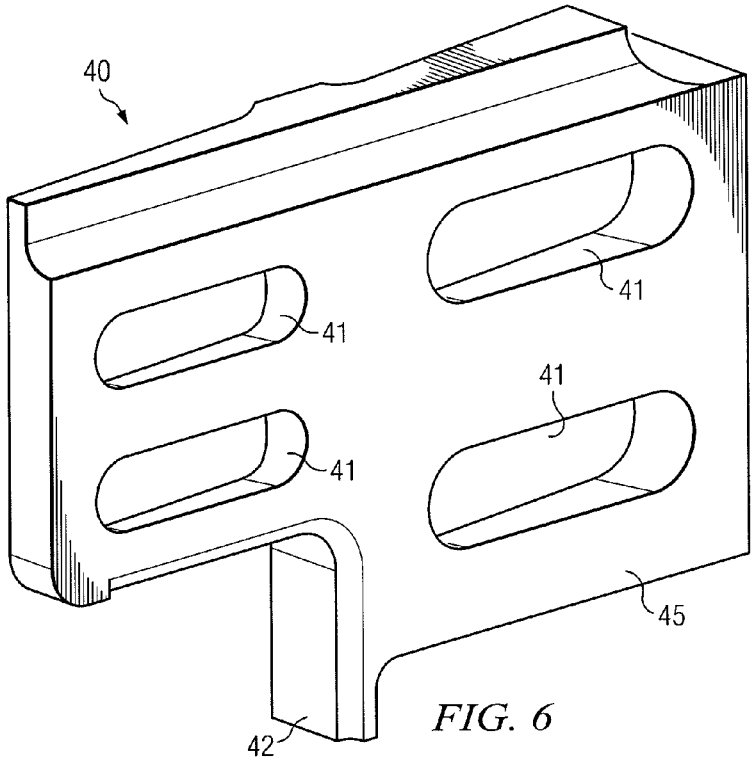
FIG. 6 illustrates a three-dimensional bottom view of the rear draft lug shown in FIGS. 1A and 1B.

FIG. 6 illustrates a three-dimensional bottom view of the bottom of rear draft lug 40. As discussed above, particular embodiments of rear draft lug 40 include bottom surface 45, overhang portion 42, and chamfered slots 41. In some embodiments, rear draft lug 40 may be coupled to a side wall of a draft sill. For example, rear draft lug 40 may be coupled to a side wall by coupling bottom surface 45, which opposes top surface 44 shown in FIG. 5, to a side wall of a draft sill (e.g., side wall 14 of draft sill 10). In some embodiments, rear draft lug 40 may be coupled to a side wall of a draft sill by welding around an exterior perimeter of bottom surface 45 and an interior perimeter of chamfered slots 41. Additionally, rear draft lug 40 may be welded to draft sill 10 without cutting slots in the draft sill 10 web, which allows for welding to the draft sill 10 web prior to assembly of draft sill 10. In some embodiments, a portion of overhang 42 may be coupled to center place 20 and/or a bottom surface of center sill 10.

Although the present disclosure has been described with several embodiments, numerous changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A system comprising:

a railcar draft sill configured to be positioned in a rail car;

a first vertical reinforcement plate; and a rear draft lug comprising:

a boss extending along a transverse portion of the rear draft lug, the boss configured to be coupled to the first vertical reinforcement plate; and an overhang portion extending from the boss along the transverse portion towards a bottom wall of the railcar draft sill, the overhang portion configured to be coupled to the first vertical reinforcement plate; and wherein the first vertical reinforcement plate is configured to be coupled to the rear draft lug with a weld.

2. The system of claim 1, wherein the vertical reinforcement plate is configured to be coupled to the rear draft lug with a continuous weld along the boss and the overhang portion.

3. The system of claim 1, wherein the rear draft lug further comprises:

a wider end configured to be positioned closest to an end of the rail car in an installed position; and a narrow end configured to be positioned closest to a center of the rail car in an installed position; and wherein the rear draft lug is generally tapered from the wider end to the narrow end.

4. The system of claim 1, wherein the rear draft lug further comprises one or more chamfered slots, wherein each of the one or more chamfered slots is configured to receive a weld along a respective interior perimeter of the chamfered slot.

5. The system of claim 1, further comprising:

a second vertical reinforcement plate; and a center plate pocket configured to receive a center plate of a rail car;

and wherein the rail car draft sill comprises one or more side walls, and wherein the center plate pocket comprises a cavity formed from the first vertical reinforcement plate, the second vertical reinforcement plate and one or more side walls of the rail car draft sill.

6. The system of claim 1, wherein the rail car draft sill comprises one or more sidewalls, and wherein the rear draft lug is configured to be coupled to at least one of the one or more side walls by receiving one or more welds along an exterior perimeter of the rear draft lug.

7. The system of claim 1, wherein the rear draft lug is formed from a one piece cast metal material.

8. The system of claim 1, wherein the first vertical reinforcement plate is configured to be coupled to the rear draft lug with a continuous weld along at least a portion of the boss.

9. A rear draft lug comprising:

a metallic body;

a boss extending along a transverse portion of the metallic body, the boss configured to be coupled to a first vertical reinforcement plate; and an overhang portion extending from the boss along the transverse portion towards a bottom wall of the railcar draft sill, the overhang portion configured to be coupled to the first vertical reinforcement plate; and wherein the boss and the overhang portion are configured to be coupled to the first vertical reinforcement plate by being coupled to the first vertical reinforcement plate with a weld.

10. The rear draft lug of claim 9, wherein the boss comprises a raised and flat portion of the metallic body extending across the transverse portion of the metallic body.

11. The rear draft lug of claim 9, wherein the metallic body further comprises:

a wider end configured to be positioned closest to an end of the rail car in an installed position; and a narrow end configured to be positioned closest to a center of the rail car in an installed position; and wherein the metallic body is generally tapered from the wider end to the narrow end.

12. The rear draft lug of claim 9, wherein the metallic body further comprises one or more chamfered slots, wherein each of the one or more chamfered slots is configured to receive a weld along a respective interior perimeter of the chamfered slot.

13. The rear draft lug of claim 9, wherein the rear draft lug is configured to form a portion of a center plate pocket in a rail car draft sill, the center plate pocket comprising a cavity formed from a second vertical reinforcement plate and one or more side walls of a rail car draft sill.

14. The rear draft lug of claim 9, wherein the rear draft lug is configured to be coupled to one or more side walls of a rail car draft sill by receiving one or more welds along an exterior perimeter of the rear draft lug.

15. The rear draft lug of claim 9, wherein the rear draft lug is formed from a piece cast metal material.

16. The rear draft lug of claim 9, wherein the boss and the overhang portion are configured to be coupled to the first vertical reinforcement plate by being coupled to the first vertical reinforcement plate with a continuous weld along at least a portion of the boss and/or overhang portion

* * * * *